US008002222B2

(12) United States Patent
Jaunault et al.

(10) Patent No.: US 8,002,222 B2
(45) **Date of Patent: *Aug. 23, 2011**

(54) PROTECTIVE GLOVE MADE FROM CHAIN MAIL PROVIDED WITH MEANS FOR TENSIONING THE CHAIN MAIL

(75) Inventors: Philippe Jaunault, Villemoisan (FR); Sophie Jaunault, Villemoisan (FR); Franck Beneteau, Champtoce sur Loire (FR)

(73) Assignee: Manulatex France, Champtoce-sur-Loire (FR)

( * ) Notice: Subject to any disclaimer, the term of this patent is extended or adjusted under 35 U.S.C. 154(b) by 32 days.

This patent is subject to a terminal disclaimer.

(21) Appl. No.: 12/296,752

(22) PCT Filed: Apr. 5, 2007

(86) PCT No.: PCT/FR2007/051076

§ 371 (c)(1), (2), (4) Date: Oct. 10, 2008

(87) PCT Pub. No.: WO2007/116187

PCT Pub. Date: Oct. 18, 2007

(65) Prior Publication Data

US 2009/0271912 A1 Nov. 5, 2009

(30) Foreign Application Priority Data

Apr. 10, 2006 (FR) ..... 06 03156

(51) Int. Cl.

| | |
|---|---|
| ***A41D 13/08*** | (2006.01) |
| ***A41D 19/015*** | (2006.01) |
| *A41D 19/00* | (2006.01) |

(52) U.S. Cl. ..... 245/2; 245/6; 245/9; 2/21; 2/161.6

(58) Field of Classification Search ..... 245/2, 4, 245/5, 6, 9; 2/16–21, 159, 160, 161.6, 167, 2/338, 339, 247, 910, 251, 252

See application file for complete search history.

(56) References Cited

U.S. PATENT DOCUMENTS 2,044,336 A * 6/1936 Schwartzman ..... 245/5

(Continued)

FOREIGN PATENT DOCUMENTS

DE 202005011181 10/2005

(Continued)

OTHER PUBLICATIONS

International Search Report filed on Nov. 23, 2007 in International Application.

*Primary Examiner* — Bobby Muromoto, Jr.

(74) *Attorney, Agent, or Firm* — Young & Thompson

(57) ABSTRACT

A protective glove includes at least one resilient member (17) integral with chain mail fabric and arranged to draw the chain mail fabric of at least one of the glove fingers (16) in the direction or substantially in the direction of the longitudinal axis thereof and toward the wrist portion (12). The resilient member or members (17) are disposed on the portion (11) intended to cover the hand. These resilient member or members (17) are preferably in the form of a flat spring of pin type. The resilient members enable the chain mail to fit at best the fingers of the hand and enable in particular to limit, or even eliminate, the presence of an excess of chain mail at the end of the glove user fingers.

17 Claims, 4 Drawing Sheets

U.S. PATENT DOCUMENTS

| | | | | |
|---|---|---|---|---|
| 2,046,564 | A * | 7/1936 | Laden | 5/230 |
| 2,256,158 | A * | 9/1941 | Weisbender | 245/2 |
| 2,380,365 | A * | 7/1945 | Morrison et al. | 428/61 |
| 2,737,663 | A * | 3/1956 | Harris | 2/161.6 |
| 3,378,181 | A * | 4/1968 | Hirsch | 224/178 |
| 4,345,730 | A * | 8/1982 | Leuvelink | 245/6 |
| 4,583,534 | A * | 4/1986 | Woods et al. | 602/23 |
| 4,599,751 | A * | 7/1986 | Bouwhuis | 2/400 |
| 5,088,123 | A * | 2/1992 | MacDonald | 2/162 |
| 5,442,815 | A * | 8/1995 | Cordova et al. | 2/161.7 |
| 5,511,241 | A * | 4/1996 | Ziegler | 2/2.5 |
| 5,568,657 | A * | 10/1996 | Cordova et al. | 2/167 |
| 5,862,521 | A * | 1/1999 | van Marwijk et al. | 2/16 |
| 6,052,829 | A * | 4/2000 | Kindler | 2/167 |
| 6,076,190 | A * | 6/2000 | Besson | 2/161.6 |
| 6,137,675 | A * | 10/2000 | Perkins | 361/679.03 |
| 6,438,759 | B1 * | 8/2002 | Jaunault et al. | 2/167 |
| 6,457,282 | B1 * | 10/2002 | O'Toole | 52/81.2 |
| 6,735,780 | B1 * | 5/2004 | Jaunault et al. | 2/48 |
| 7,062,792 | B2 * | 6/2006 | Jaunault et al. | 2/161.6 |
| 7,188,373 | B2 * | 3/2007 | Jaunault et al. | 2/161.6 |
| 7,237,272 | B2 * | 7/2007 | Botcher | 2/161.6 |
| 7,845,020 | B2 * | 12/2010 | Jaunault et al. | 2/159 |
| 2004/0025223 | A1 * | 2/2004 | Jaunault et al. | 2/159 |
| 2004/0181848 | A1 * | 9/2004 | Jaunault et al. | 2/161.6 |
| 2005/0144700 | A1 * | 7/2005 | Lattari | 2/161.6 |
| 2007/0042210 | A1 * | 2/2007 | Horsham | 428/544 |

FOREIGN PATENT DOCUMENTS

| | | |
|---|---|---|
| FR | 1053579 | 2/1954 |
| FR | 2864752 | 7/2005 |
| GB | 2275174 | 8/1994 |
| WO | 2005011416 | 2/2005 |

* cited by examiner

PROTECTIVE GLOVE MADE FROM CHAIN MAIL PROVIDED WITH MEANS FOR TENSIONING THE CHAIN MAIL

The present invention relates to gloves made of chain mail fabric.

Gloves made of chain mail fabric, namely made of a latticework of interweaved metal rings, are widely used in various industries, in particular the meat industry, for the protection of the operator's hand against cutting or perforation risks linked to the use of cutting or sharp tools.

These gloves comprise a portion intended to cover the hand (formed of a back portion, a palm portion and glove fingers), extended by a wrist covering portion which is generally fitted out with a closing member that can be a tightening strap or a tightening resilient element (for example a "spiral" flat spring or an "helical" annular spring). This wrist covering portion can be itself extended by an element for covering the forearm, the arm or even the shoulder.

Such gloves are described, for example, in GB-2 275 174, U.S. Pat. No. 5,088,123, or even DE-20 2005 011 181. It is to be noted that some of the gloves presented in these prior art documents have a cuff for protection of the forearm (or a part of the forearm), fitted out with flexible stiffening members, longitudinally non-resilient or virtually non-resilient, adapted to hold the chain mail fabric in place on the user's limb.

Generally, several sizes of gloves are provided and the user chooses within the proposed range so as to optimize his/her comfort according to the size of his/her hand. But, due to the structure thereof, the chain mail is a non-resilient supple fabric and has the particularity to be deformable in the direction perpendicular to the stretched state thereof. So, it is necessary to oversize some of the areas thereof (in particular, the length of the glove fingers) so as to have enough material to accommodate the flexion of the joints. However, said oversizing creates a chain mail excess at the end of the fingers when the latter are in an extended condition. This excess of material is often discomfortable, impairs product or object gripping quality, and can be a source of risks.

There exist disposable accessories, called "glove-fastener" or "glove-tightener", that consist of added-on resilient structures able to hug the hand and to position between some fingers of the hand.

But these accessories are long to position and need to be regularly replaced. They often tend to hug the hand too tightly. Moreover, they generate discomfortable situations of compression of the glove chain mail fabric rings in some inter-finger areas.

The object of the present invention is to remedy these shortcomings thanks to a chain mail glove that limits, or even eliminates, the presence of an excess of material at the end of the fingers, so as to better fit the hand of the user, whether the fingers are in an extended or a flexed condition.

So, it is proposed a glove of which the comfort, the gripping quality and the safety of use are improved.

To this end, the protective glove according to the present invention is characterized in that it comprises at least one resilient member integral with the chain mail fabric, arranged to draw the chain mail fabric of at least one of the glove fingers in the direction or substantially in the direction of the longitudinal axis thereof and toward the wrist portion. Said resilient member or members, at rest or in a partially active state, create a prestress on some areas of the chain mail fabric (materialized by a tightening of the material). After the glove is slipped on, with the fingers of the hand in an extended state, the resilient members are at rest, or active, but at a stage that can be described as intermediate; they draw the chain mail fabric so as to limit or eliminate the presence of an excess of material at the end of the fingers. During the flexing movement of the fingers, the tensed state of the resilient members increases enabling the chain mail fabric to stretch. Then, when the fingers return to an extended condition, said resilient members naturally come back to the aforementioned rest or intermediate tension stage.

It is so provided an optimal constant covering of the user's hand, and in particular of at least some of the glove fingers, and preferably of all the glove fingers.

The number, the position and the extension characteristics of the resilient members are adapted according to the sought final result and so as to limit as much as possible the discomfort of glove wearer.

Said resilient member or members are preferably arranged on the glove portion intended to cover the user's hand.

According to a first possible embodiment, at least one of the resilient members is in the form of a compression spring disposed on the portion covering the back or the palm of the hand, active in a perpendicular or substantially perpendicular direction relative to the longitudinal axis of at least one of the glove fingers.

According to another possible embodiment, at least one of the resilient members is in the form of a tension spring, active in the direction or substantially in the direction of the longitudinal axis of at least one of the glove fingers, and disposed on the portion covering the back and/or the palm of the hand.

In the scope of this second embodiment, the glove advantageously comprises at least two spring members disposed parallel or substantially parallel to each other, arranged so as to be active on the five glove fingers. In particular, the corresponding glove can comprise three spring members one of which is located in the extension from the glove finger corresponding to the thumb of the user.

According to another particularly interesting characteristic, at least one of the resilient members is in the form of a flat spring, of pin type, consisting of a juxtaposition of arms running in the same plane or substantially in the same plane, connected by pairs by an elastic joint.

According to a first embodiment, at least one of the springs consists of a juxtaposition of two arms connected by an elastic joint, forming together a U-shaped or V-shaped structure. According to a second embodiment, at least one of the springs consists of a juxtaposition of at least three arms connected by pairs by an elastic joint, forming a juxtaposition of U-shaped or V-shaped structures disposed head to tail relative to each other.

The joint that connects two juxtaposed arms of the spring advantageously consists of a loop of material having one or more turns, the articulation axis of which runs perpendicular or substantially perpendicular relative to the plane of the two juxtaposed arms connected thereby. In case of several turns, the latter can be superimposed and/or juxtaposed.

According to another feature, the two free ends of the spring are provided with a loop.

According to still another characteristic, the resilient member or members connect at least two spaced-apart metal rings of the chain mail fabric. The connexion between the resilient member or members and the chain mail is then made by means of metal rings, in particular through the abovementioned loops shaped on said resilient member or members.

In a particular embodiment, the resilient member or members are accommodated in a pocket or a sleeve provided in the chain mail fabric.

The invention will be further illustrated, without being in any way limited, by the following description associated with the attached drawings, in which.

Figure 1:
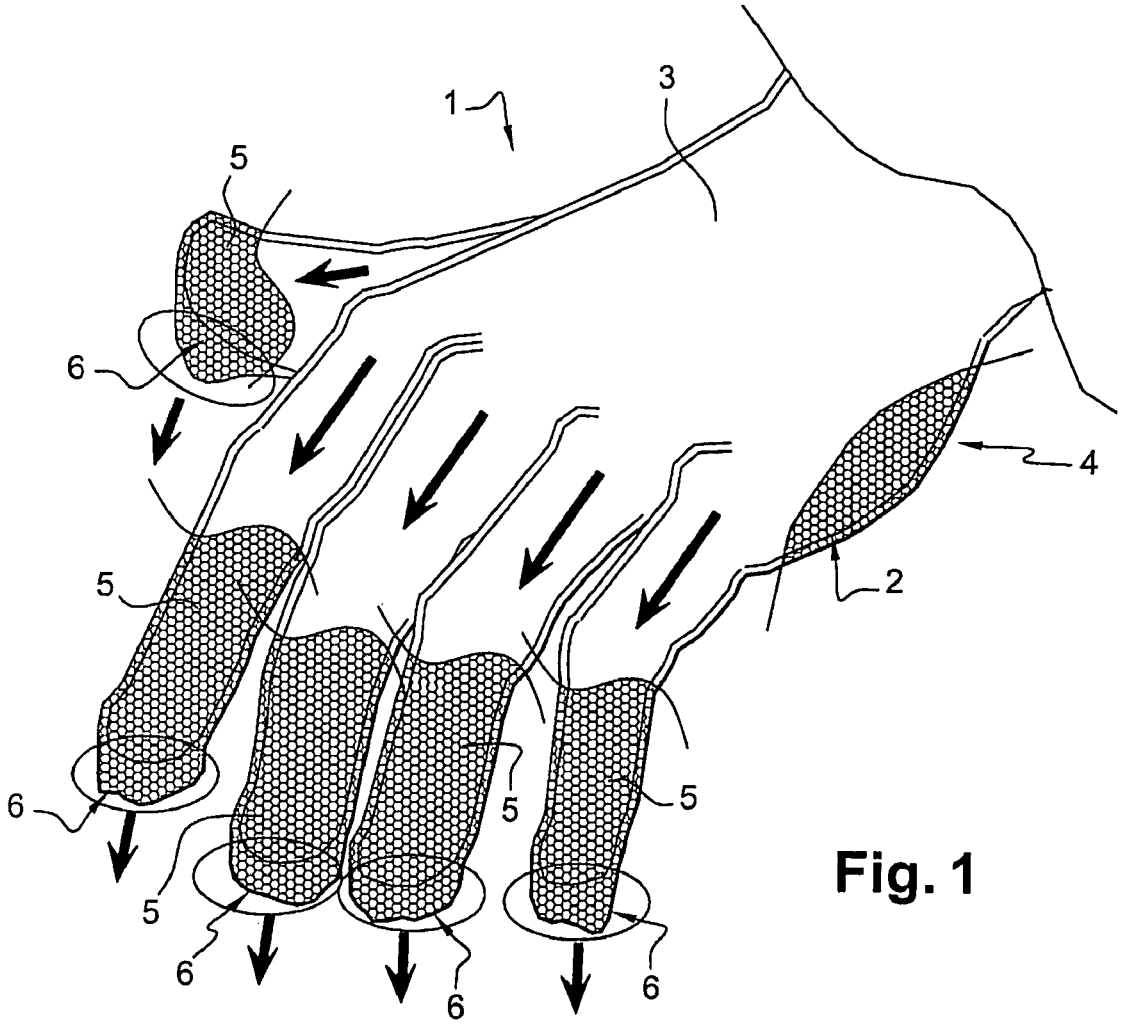
FIG. 1 is a schematic view of the "hand" portion of a chain mail glove of the prior art, in which it can be noticed an excess of material at the end of the fingers when the latter are in an extended position.

The glove 1 illustrated in FIG. 1 is a prior art glove made of chain mail fabric. This figure shows the "hand" portion 2 of this glove 1, comprising:

a portion 3 intended to cover the back of the hand, a portion 4 intended to cover the palm of the hand, and glove fingers 5.

It can be noticed that, in an extended condition of the user's fingers, there is an excess of material 6 at the end of the distal phalange of the fingers, linked to the abovementioned necessary oversizing to enable flexing movements, in relation with the suppleness and the non-resilient character of the chain mail fabric.

Figure 2:
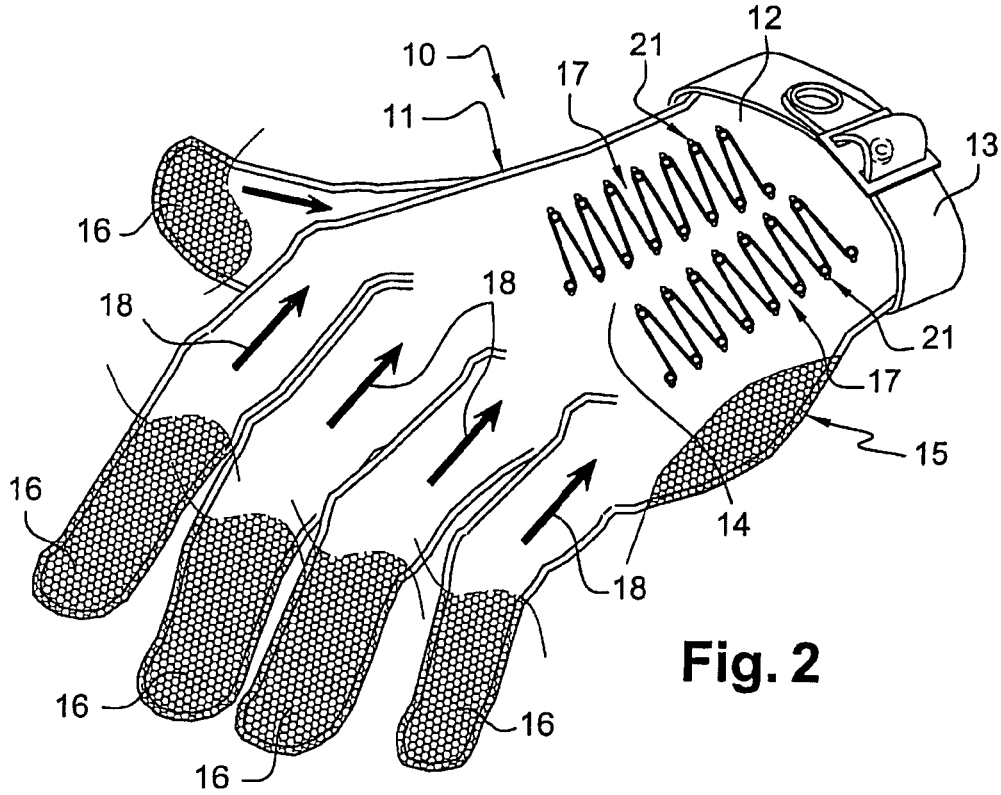
FIG. 2 shows a chain mail glove according to the invention, fitted out with a particular form of flat spring-type resilient member, the glove being herein represented with the fingers in an extended position.
Figure 3:
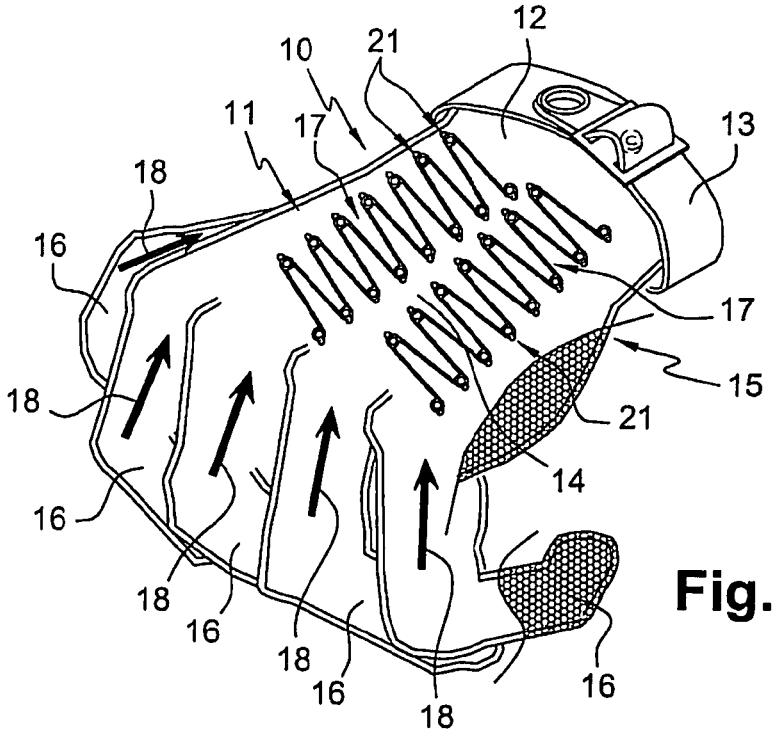
FIG. 3 shows the glove of FIG. 2, with the fingers in a flexed position.

This problem can be addressed by the glove 10 according to the invention, illustrated in FIGS. 2 and 3.

The corresponding glove 10 comprises a portion 11 intended to cover the hand, made of chain mail fabric, extended by a wrist covering portion 12 (also made of chain mail fabric). This wrist covering portion 12 is provided with a closing system, herein made in the form of a tightening strap 13. In embodiment variants, this wrist portion can be itself extended by a portion that covers the forearm and possibly the arm and the shoulder. These extension portions will then be fitted out with conventional stiffening members to correctly hold the chain mail on the user's limb.

The "hand" portion 11 of glove 10 conventionally comprises a portion 14 intended to cover the back of the hand, a portion 15 intended to cover the inner part (palm) of the hand, and five glove fingers 16. The sizes of the different portions of the glove are classical or substantially classical, in accordance with standard sizes.

According to the invention, the "hand" portion 11 of glove 10 is fitted out with resilient members 17, connecting at least two spaced-apart rings of the chain mail fabric, adapted to continuously draw the chain mail fabric of the glove fingers 16, in the direction of the longitudinal axis of the fingers and toward the wrist portion 12, as illustrated by direction arrows 18.

Resilient members 17 can take any possible form and can be arranged on any area of the glove. Preferably, they are arranged so as to correctly fulfill their function while limiting the discomfort for the wearer of the glove.

To this end, in the embodiment illustrated in FIGS. 2 and 3, resilient members 17 are in the form of flat springs which are fitted on the portion 14 covering the back of the hand.

Here, there are two flat springs 17 arranged parallel to each other; they are in the form of tension springs each fastened on the chain mail fabric so that the working direction thereof is parallel or substantially parallel to the longitudinal axis of the glove fingers 16. Preferably, the number and the position of the springs 17 are adapted so as to provide an action on the five glove fingers 16.

In addition to the two springs 17 fitted on the glove of FIGS. 2 and 3, an additional spring can be placed in the extension from the glove finger 16 corresponding to the thumb of the hand.

Also, in embodiment variants, the portion 15 covering the palm of the hand can be fitted out with such springs 17, in addition or in alternative to that fitted on the back portion of the glove 14.

Figure 4:
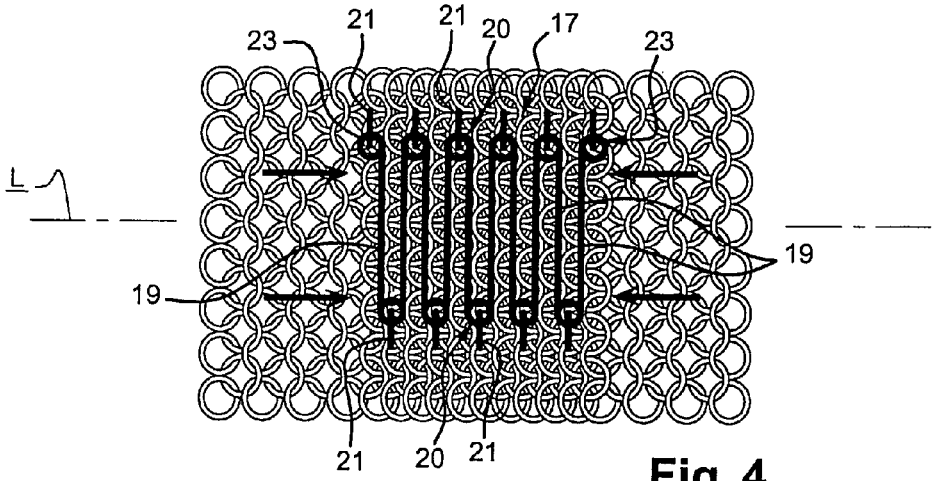
FIG. 4 shows the spring member used on the glove of FIGS. 2 and 3, herein illustrated positioned on a chain mail panel and in a stable (rest) state providing a tightening of the material mails.
Figure 5:
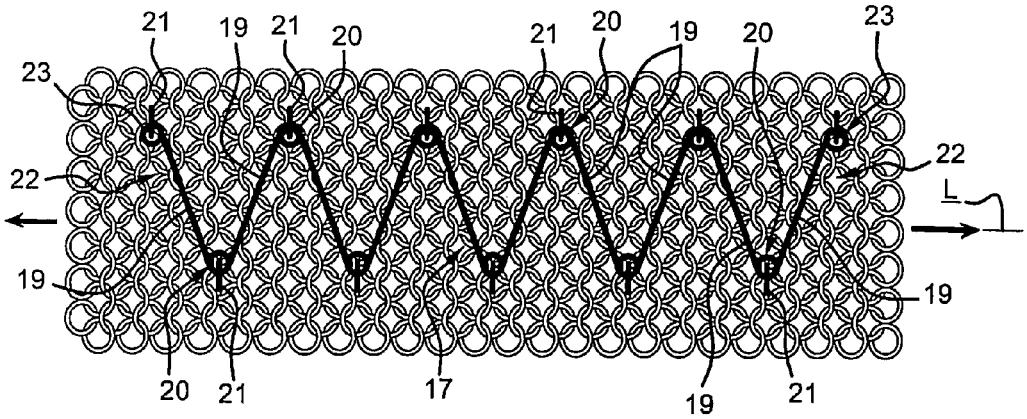
FIG. 5 shows the spring member of FIG. 4, herein illustrated in the tensed state, following a stretching of the chain mail panel.

FIGS. 4 and 5 describe the particular structure of flat springs 17 and their action on the fitted out chain mail.

These flat springs 17 each consist of a plurality of arms 19 connected by pairs by an elastic joint 20, so as to form a juxtaposition of Us or Vs disposed head to tail relative to each other.

In view of the function and the arrangement of these springs 17, arms 19 all extend in the same plane or substantially in the same plane. The corresponding plane is parallel or merged with that of the chain mail fabric fitted out with springs 17; and each elastic joint 20 run perpendicular to this plane.

In the illustrated embodiment, springs 17 are made of metal wire, for example from a stainless steel wire the diameter of which is comprised between 0.5 mm and 1 mm. In embodiment variants, they can also be obtained in a plastic, organic or textile material.

Arms 19 are straight and are herein the same length (which may not be always the case). They are connected by an elastic joint formed of a circular loop 20 that can have one or more turns.

A generally accordion-shaped structure is obtained, having elastic joints 20 that are located in the plane or substantially in the plane of the two juxtaposed arms 19 connected thereby, and the axis of which is perpendicular or substantially perpendicular to said plane of the two juxtaposed arms 19 connected thereby.

In addition to the "elastic joint" function thereof, loops 20 enable the spring members to be fastened on the chain mail fabric by means of added-on metal rings 21.

In FIGS. 2 to 4, it can be noticed that the free ends 22 of springs 17 are also fitted out with an additional loop 23 enabling the fastening on the chain mail fabric also by means of added-on metal rings 21.

The "spring" function of resilient structures 17 is obtained through elastic joints 20, and possibly also through a certain flexibility of arms 19.

Spring 17 is in the form of a strip that can be 1 to 3 cm wide and that is resilient in the direction of the longitudinal axis L thereof. It is preferably fastened on the outer face of the chain mail fabric, but it is perfectly conceivable to position it on the inner face side of the glove, or else to interweave it within the chain mail fabric.

As abovementioned, spring 17 acts in traction; At rest state, the different arms 19 thereof are close together as illustrated in FIG. 4; in this case, the different arms 19 then run parallel to each other. On the other hand, an outward traction on the two free ends 22 provides the tensioning or drawing thereof, as illustrated in FIG. 5.

To correctly fulfill the function thereof, spring 17 is fastened on the chain mail so as to provide at rest a tightening of the material, namely an extensive partial superimposition of the rings of the chain mail fabric (FIG. 4). So, a traction on the chain mail fabric will cause the stretching of the material and in the same time the tensioning of spring 17 (FIG. 5), which will enable the mail to return to the tightened position after the canceling of the abovementioned traction effect.

So, it will be well understood that a suitable arrangement of spring or springs 17 on glove 10 of FIGS. 1 and 2 enables at rest to produce a tightening of the material on the part 14 covering the hand (namely the area in which the springs are placed), causing consequently a traction on the chain mail fabric of the glove fingers. The corresponding traction is produced in the plane or substantially in the plane of the chain mail.

So, when the user slips glove 10 on, glove fingers 16 in an extended condition cover suitably the fingers of the hand (FIG. 2). The excess of material related to the necessary oversizing is then accumulated at the level of springs 17 on the hand back portion 14. The corresponding excess of material (or the corresponding material stock) is used during the flexion of the fingers (FIG. 3).

It is so obtained a glove the finger portions 16 of which are continually tensed and which generally fits at best the hand of the user (without needing the presence of added-on members of prior art "glove-fastener" or "glove-tightener" type, acting by compression and causing the presence of material over-thicknesses between the fingers).

In an extended condition of the fingers, spring members 17 can be arranged so as to be at the rest state, or at a state of light tension.

This very comfortable glove improves the gripping quality for the user and also optimizes the security.

Moreover, the particular spring implemented herein has a much reduced thickness (limited to the diameter of the wire and to the thickness of the loop or loops), which enables to limit as much as possible the discomfort caused by the presence thereof.

Figure 6:
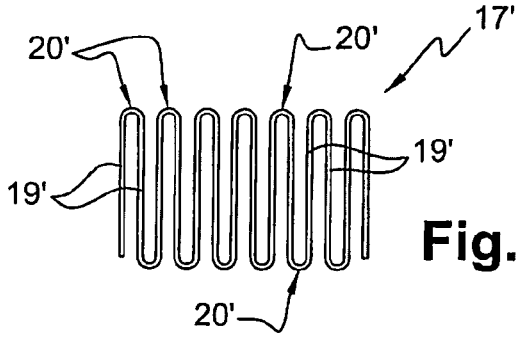
FIG. 6 illustrates a first possible embodiment variant of the spring member, at the rest state.
Figure 7:
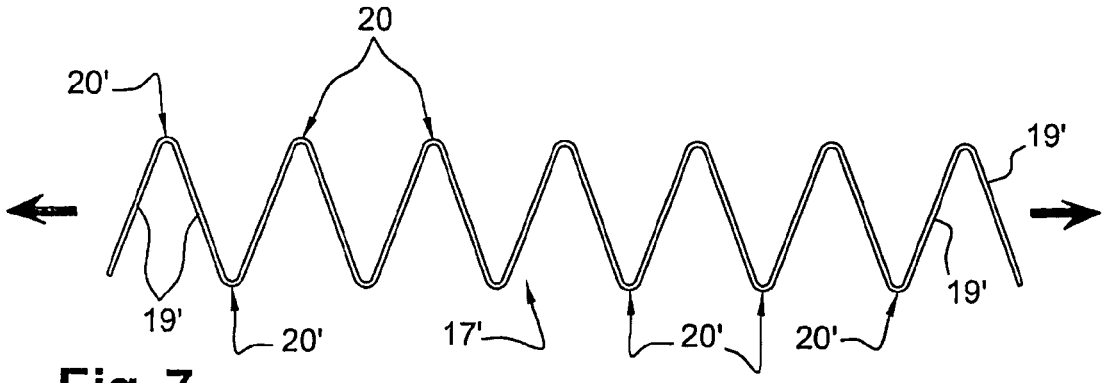
FIG. 7 shows the spring of FIG. 6 at the tensed state (following a stretching of the supporting chain mail fabric)

FIGS. 6 and 7 show a possible embodiment variant of the tension flat spring liable to be used to obtain a glove according to the invention.

This flat spring 17', illustrated at the rest state in FIG. 6 and at the tensed state in FIG. 7, consists of a juxtaposition of arms 19' connected by pairs by an elastic joint 20' herein formed of a simple material bend. The different arms 19' and the articulation bends 20' run in the same plane; the thickness of this spring 17' is thus limited to the thickness of the wire (metallic or other) that is used.

Figure 8:
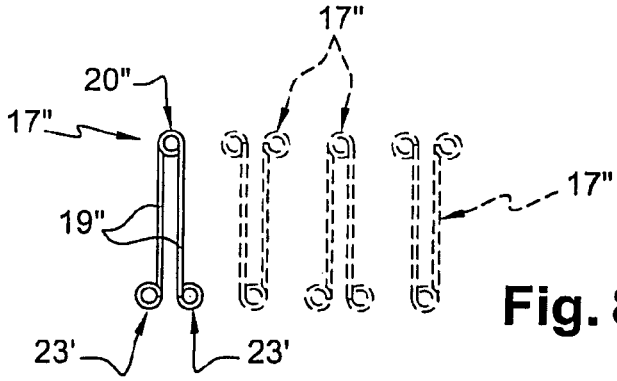
FIG. 8 illustrates a second embodiment variant of the spring member consisting of only two arms connected by an elastic joint.
Figure 9:
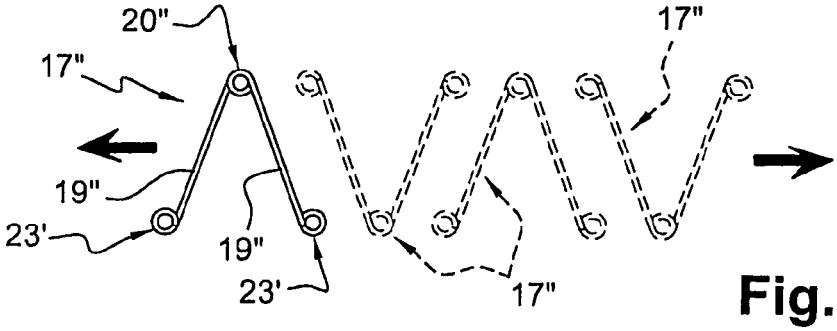
FIG. 9 shows the spring member of FIG. 8 at the tensed state, following a stretching of the supporting chain mail fabric.

A second possible embodiment variant is illustrated in FIGS. 8 and 9. Herein, the spring member 17" consists of a simple juxtaposition of two arms 19" connected by a resilient loop 20". The free ends of the arms 19" comprise a supplementary loop 23' enabling spring element 17" to be fastened on the chain mail fabric by means of added-on rings (or the like); the resilient loops 20" also serve as fastening members on the chain mail by means of added-on rings (or the like).

As illustrated in dotted line, a plurality of springs 17" can be associated together to form the resilient member. In this case, the springs are preferably disposed head to tail relative to each other, one after the other.

Of course, the invention is not limited to the herein described and illustrated embodiments. Thus, for example:

the implemented spring member or members can be compression springs, then disposed to act transversally to the longitudinal axis of the glove fingers, the transversal tensioning obtained on the chain mail fabric providing a traction of the material of the glove fingers toward the wrist portion 12.

other types of resilient members can by used, for example helical cylindrical springs with a small diameter, disposed on the hand covering portion 14, or directly on the glove fingers 16, for example at the distal phalange of the fingers. The corresponding resilient member or members will be able to be fastened on the chain mail to connect two spaced-apart rings, by means of end loops, possibly associated to additional fastening rings.

the resilient member or members can be releasably fitted on the glove, by any suitable fastening means.

the resilient member or members can be accommodated in a pocket or a sleeve provided at the desired location on the glove, in particular a pocket or a sleeve made of chain mail fabric.

The invention claimed is:

1. Protective glove comprising:

a hand portion (11) adapted to cover a hand of a user and made of chain mail fabric of an interweaving of metal rings, said hand portion (11) comprising a palm portion (15) adapted to cover a palm of the hand, a back portion (14) adapted to cover a back of the hand, and glove fingers (16) extending from said back and palm portions, each of said glove fingers being adapted to cover a respective finger of the hand and having a respective longitudinal axis;

a wrist portion adapted to cover a wrist of the user and from which said palm and back portions extend, said wrist portion comprising a closing system; and at least one resilient member (17, 17', 17") integral with the chain mail fabric of said hand portion and distinct from said closing system, wherein said at least one resilient member has a working direction defining a rest state and a tensioned state, wherein said at least one resilient member is fastened to said chain mail fabric so that said working direction is at least substantially parallel to the longitudinal axis of at least one of said glove fingers, said at least one resilient member thus being active substantially in a direction of the longitudinal axis of the at least one of said glove fingers to draw the chain mail fabric of the at least one of said glove fingers (16) in the direction or substantially in the direction of the longitudinal axis thereof and toward said wrist portion (12).

2. The protective glove according to claim 1, wherein said at least one resilient member (17, 17', 17") is on said back portion.

3. The protective glove according to claim 2, wherein said at least one resilient member (17, 17', 17") is a tension spring active in the direction or substantially in the direction of the longitudinal axis of the at least one of the glove fingers (16).

4. The protective glove according to claim 1, wherein said at least one resilient member (17, 17', 17") is on said palm part (15) and active in the direction or substantially in the direction of the longitudinal axis of the at least one of the glove fingers (16).

5. The protective glove according to claim 1, wherein said at least one resilient member comprises at least two spring members (17) disposed parallel or substantially parallel to each other, arranged so as to be active on said glove fingers (16).

6. The protective glove according to claim 5, wherein said at least one resilient member comprises three spring members (17) disposed parallel or substantially parallel to each other, one of which being located in the extension from the glove finger corresponding to a thumb of the user.

7. The protective glove according to claim 1, wherein said at least one resilient member (17, 17', 17") is a flat spring of a pin type that includes a juxtaposition of arms (19, 19', 19") in the same plane connected in pairs by an elastic joint (20, 20', 20").

8. The protective glove according to claim 7, wherein said flat spring includes a juxtaposition of two said arms (19") connected by one said elastic joint (20") and forming together a U-shaped or V-shaped structure.

9. The protective glove according to claim 7, wherein said flat spring includes a juxtaposition of at least three said arms (19, 19') connected in pairs by a respective said elastic joint (20, 20') and forming a juxtaposition of U-shaped or V-shaped structures disposed head to tail relative to each other.

10. The protective glove according to claim 7, wherein said elastic joint comprises a 360° loop of material (20, 20") having one or more turns, the articulation axis of which is perpendicular to the plane of the two juxtaposed arms connected thereby.

11. The protective glove according to claim 7, wherein two free ends of the spring (17, 17") are each provided with a loop (23, 23') that is connected to the metal rings of the chain mail fabric.

12. The protective glove according to claim 1, wherein said at least one resilient member (17, 17") is connected to at least two spaced-apart metal rings of the chain mail fabric of said back portion with loops (20, 23, 20", 23').

13. The protective glove according to claim 1, wherein said at least one resilient member (17, 17', 17") is in a pocket or a sleeve in the chain mail fabric.

14. A protective glove comprising:

a hand portion adapted to cover a hand of a user and made of chain mail fabric of interwoven metal rings, said hand portion comprising a palm portion adapted to cover a palm of the hand, a back portion adapted to cover a back of the hand, and glove fingers extending from said back and palm portions;

a wrist portion adapted to cover a wrist of the user and from which said palm and back portions extend; and a linear resilient member having two distal end portions attached to the chain mail fabric of said back portion and compressing said back portion, said linear resilient member being aligned with a direction from said glove fingers toward said wrist portion and pulling the chain mail fabric of said glove fingers toward said wrist portion, wherein said resilient member is a flat spring of a pin type that includes plural arms in the same plane connected in pairs by respective elastic joints that include a 360° loop of elastic material, wherein an articulation axis of said joint is perpendicular to the plane of said arms.

15. The protective glove according to claim 14, wherein said linear resilient member is one of a compression spring and a tension spring.

16. The protective glove according to claim 14, further comprising a second resilient member arranged parallel and adjacent to said linear resilient member, said second resilient member having two distal end portions attached to the chain mail fabric of said back portion and compressing said back portion.

17. The protective glove according to claim 14, wherein the distal ends of said resilient member are connected to spaced-apart metal rings of the chain mail fabric with respective loops.

* * * * *